United States Patent [19]

Goetz

[11] 3,948,008

[45] Apr. 6, 1976

[54] PREFABRICATED STRUCTURAL ELEMENT, ESPECIALLY BALCONY ELEMENT

[76] Inventor: Werner Goetz, Obereschacher Str. 9, 773) Villingen-Schwenningen, Germany

[22] Filed: June 20, 1974

[21] Appl. No.: 481,385

[30] Foreign Application Priority Data

June 25, 1973 Germany ..... 7323502[U]

[52] U.S. Cl. ..... 52/73; 52/251; 52/258; 52/259; 52/262

[51] Int. Cl.[2] ..... E04B 1/34; E04B 1/04

[58] Field of Search ..... 52/259, 262, 73, 251, 252, 52/236, 258, 79

[56] References Cited

UNITED STATES PATENTS

| | | | |
|---|---|---|---|
| 3,136,092 | 6/1964 | Contini | 52/73 |
| 3,354,593 | 11/1967 | Zukas | 52/73 X |
| 3,372,519 | 3/1968 | Russell | 52/285 X |
| 3,487,597 | 1/1970 | Gutt | 52/251 X |
| 3,530,626 | 9/1970 | Mezes | 52/262 X |
| 3,562,979 | 2/1971 | Ali-Oglu | 52/236 X |
| 3,618,278 | 11/1971 | Mouton, Jr. et al. | 52/262 X |
| 3,757,477 | 9/1973 | McCrillis et al. | 52/236 |
| 3,775,928 | 12/1973 | Dawson et al. | 52/741 |
| 3,800,493 | 4/1974 | Livingston | 52/79 X |
| 3,805,469 | 4/1974 | Renstrom | 52/262 |
| 3,812,637 | 5/1974 | Yang et al. | 52/236 X |
| 3,818,660 | 6/1974 | Dillon | 52/259 |
| 3,867,805 | 2/1975 | Mikami et al. | 52/252 |

FOREIGN PATENTS OR APPLICATIONS

| | | | |
|---|---|---|---|
| 6,613,050 | 3/1968 | Netherlands | 52/79 |
| 865,652 | 2/1953 | Germany | 52/79 |
| 1,459,909 | 9/1969 | Germany | 52/259 |
| 1,380,514 | 10/1964 | France | 52/259 |
| 108,903 | 2/1968 | Denmark | 52/236 |
| 271,815 | 9/1968 | Austria | 52/236 |

*Primary Examiner*—Ernest R. Purser
*Assistant Examiner*—Leslie A. Braun
*Attorney, Agent, or Firm*—Wolfgang G. Fasse; Willard W. Roberts

[57] ABSTRACT

The present prefabricated structural element is especially adapted for the formation of balconies or other cantilevered structures. To this end a floor slab section or main section is joined to a balcony or cantilevered section by reinforcing steel elements which are connected to or in both sections and which bridge a gap between the sections. The gap width between the sections is preferably narrower than the top width of a supporting member, such as a wall or header, so that the gap may be filled with poured-in-place concrete once the element is properly placed in the desired position on top of the header or other supporting structure.

7 Claims, 4 Drawing Figures

PREFABRICATED STRUCTURAL ELEMENT, ESPECIALLY BALCONY ELEMENT

BACKGROUND OF THE INVENTION

The present invention relates to prefabricated structural elements, especially cantilevered elements suitable for constructing a balcony or the like. It is known to employ for the construction of balconies prefabricated panels or slabs. Such a balcony panel or slab and the respective floor slab have initially a thickness which is smaller than the thickness of the finished balcony or the finished floor. The structural assembly is accomplished by resting the balcony slab with one side on the supporting wall to abut the adjacent floor slab. The opposite side facing away from the floor slab and away from the wall is initially supported by means which are later removed. After placing the balcony slab in the just described manner, reinforcing rods are applied to the balcony slab and to the floor slab, whereupon poured-in-place concrete is applied over the balcony slab and over the floor slab, whereby the reinforcing rods are embedded and the balcony portion is interconnected with the adjacent floor slab. The above mentioned supporting means may only be removed after the poured-in-place concrete has sufficiently hardened. Only after such hardening is it possible to place loads on the balcony.

The above described conventional method of constructing balconies has several disadvantages. One such disadvantage is seen in that the above mentioned additional supporting means are required. Another drawback is seen in the time required for the hardening of the reinforced poured-in-place concrete. A still further drawback is seen in that the unitary structure formed from the balcony slab and the floor slab rigidly interconnected with each other by the reinforced poured-in-place concrete form a unitary plate which rests on the supporting wall or header without contributing to the load carrying capacity of the header. As a result, the height of the header, which may be taken into consideration in calculating the structural strength, is only that portion reaching to the bottom surface of the floor slab. Thus, in order to provide for the necessary supporting strength, the header must comprise additionally a double T-supporting girder.

OBJECTS OF THE INVENTION

In view of the above, it is the aim of the invention to achieve the following objects, singly or in combination:

to provide a prefabricated cantilevered, structural element, especially suitable for the construction of balconies or the like, which does not require any additional supporting elements for its installation;

to provide a cantilevered, structural element which is rigidly connected to the adjacent floor slab, so that loads may be placed on the balcony immediately after the installation of the prefabricated element;

to construct the interconnection between the floor slab section and the balcony or cantilevered section of the structural element in such a manner that a rigid interconnection between the supporting wall or header structure is easily and economically accomplished in a simple manner;

to provide a rigid interconnection between a cantilevered element and its supporting structure, such as a wall or header; and to construct the prefabricated structural element and the supporting wall top or header in such a manner that the sections of the structural element and the top of the header form a casing for poured-in-place concrete which rigidly interconnects the element with its support.

SUMMARY OF THE INVENTION

According to the invention, there is provided a prefabricated structural element, especially a balcony or cantilevered element having a cantilevered section and a floor slab section which are rigidly interconnected with each other. The sections are made of reinforced concrete and the interconnecting means may comprise ribs also made of reinforced concrete. These ribs or at least the reinforcing steel rods of these ribs are embedded in the floor section and in the cantilevered section. Further, the ribs are spaced from each other and arranged in such a manner that they also space the sections from each other so as to form a gap between these sections, whereby the gap has a predetermined width.

In a preferred embodiment of the invention, the floor slab has a given thickness and the ribs interconnecting the floor slab with the cantilevered section have a height smaller than said given thickness.

According to the invention there is further provided a rigid connection between the top surface of a supporting wall or header and the prefabricated element. To this end the supporting wall or header is provided with connecting bails which preferably are embedded in the header and reach upwardly out of the header. The bails are spaced from each other and are oriented relative to each other in such a manner that they extend through the gaps between adjacent ribs of the prefabricated element. The connecting bails have such a height that they extend somewhat above the top surface of the ribs. Thus, interconnecting rods may be inserted into the bails and extending across the interconnecting ribs, whereby the ribs are rigidly secured in position. Thereafter, the gap formed by the side walls of the sections facing each other and the top surface of the supporting wall or header, is filled with poured-in-place concrete thus forming a rigid, integral connection between the prefabricated element and its supporting member, such as a wall or header.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figure 1:
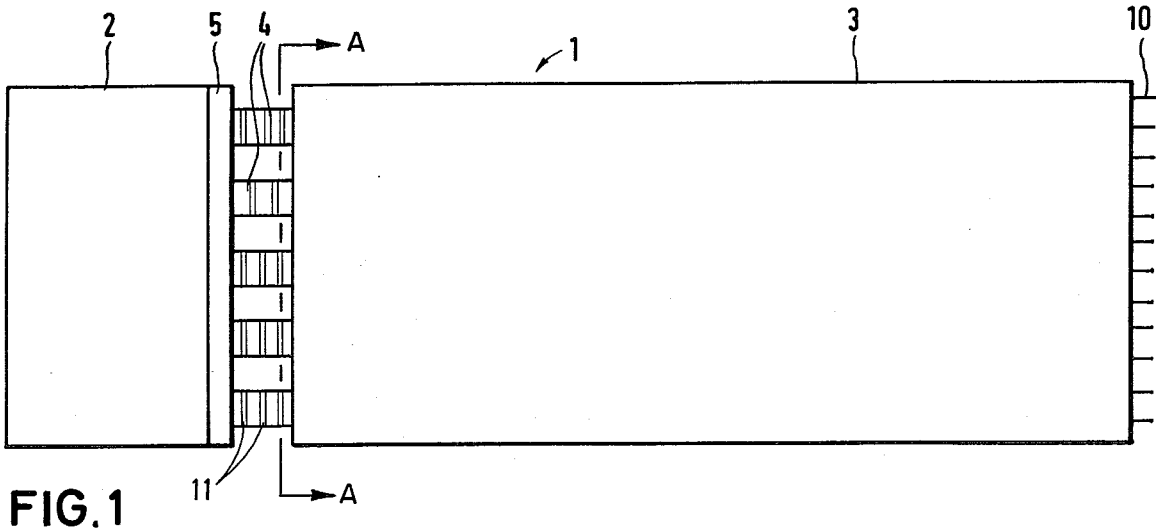
FIG. 1 illustrates a top plan view of the prefabricated structural element according to the invention.
Figure 3:
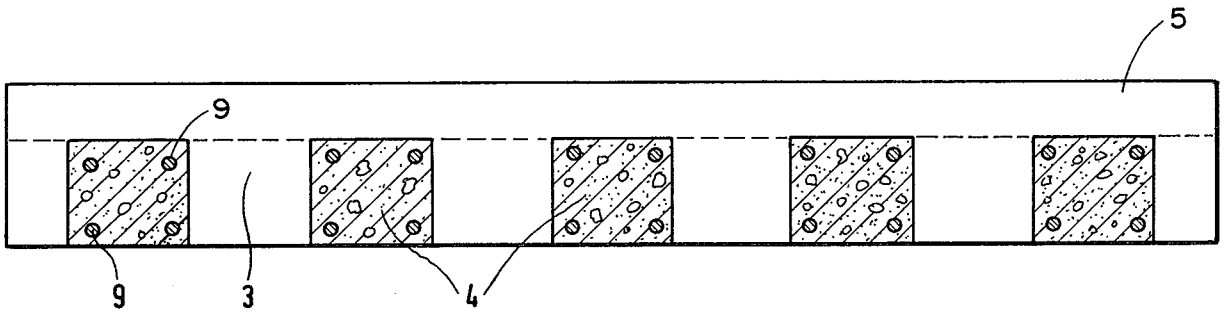
FIG. 3 is a sectional view along the section line A—A in FIG. 1 on a somewhat enlarged scale.

The prefabricated structural element 1 illustrated in the figures comprises a cantilevered or balcony section 2 and a floor slab section 3. These sections 2 and 3 are rigidly connected to each other to form a unitary structure. The interconnection is accomplished by ribs 4 spaced from each other as best seen in FIGS. 1 and 3 and provided with grooves 11 in their side walls. The grooves 11 serve for providing an intimate intermeshing bond between the ribs and poured-in-place concrete as will be described below.

Figure 2:
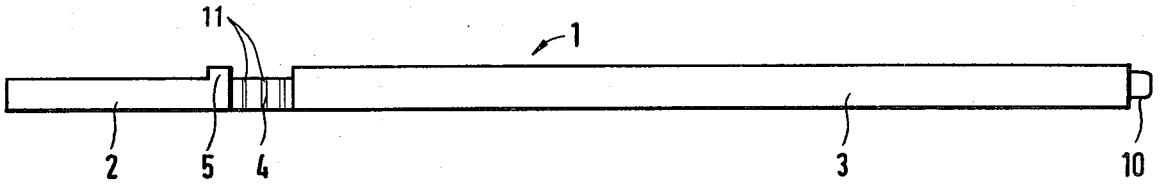
FIG. 2 illustrates a side view of the embodiment shown in FIG. 1.

As seen in FIGS. 2 and 3, the cantilevered section 2 forming the balcony proper has usually or preferably a thickness which is smaller than the respective thickness of the floor slab 3. However, the section 2 is provided with a step or ridge 5 extending along its side facing the floor slab 3. The ridge 5 has a height corresponding to the thickness of the floor slab 3.

The floor slab section 3 is provided with interconnecting bails 10 extending out of its end opposite the ribs 4. These interconnecting bails are made of bend rods such as steel reinforcing rods, one leg of which is embedded in the lower half of the floor slab 3 and the return leg of which is embedded in the upper half of the floor slab 3. The resulting bend bail 10 extends out of the side wall of the slab 3 to an extent sufficient for forming an interconnection with adjacent structural members, for example, another floor slab not shown. Incidentally, the interconnecting ribs 4 also have a thickness smaller than the thickness of the floor slab 3 as may be seen in FIG. 2 and in FIG. 4.

FIG. 3 illustrates the interconnecting ribs 4 in a sectional view. These ribs 4 may be formed from reinforced concrete having embedded therein reinforcing steel rods 9, which if desired, may be intermeshed or otherwise interconnected with each other to form reinforcing mats which are preferably embedded in the floor slab 3 as well as in the cantilevered section 2. The reinforcing ribs 4 are spaced from each other as best seen in FIG. 3.

Figure 4:
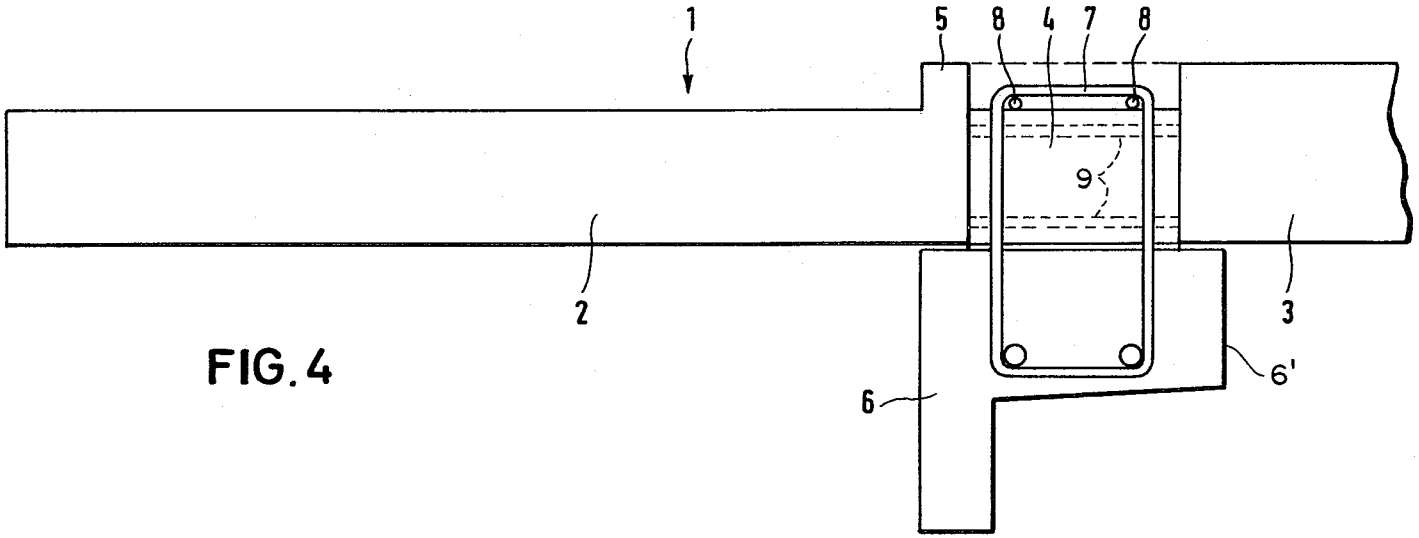
FIG. 4 shows, again, on a somewhat enlarged scale a side view of the structural elements according to the invention rigidly secured on top of a supporting wall or header.

The floor slab 3 and the cantilevered slab 2 are spaced from each other as best seen in FIG. 4 to form a gap between the side walls facing each other, whereby the gap is bridged by the interconnecting ribs 4. To rigidly secure the prefabricated element according to the invention, to a supporting wall 6 or the like, the wall is provided at its top with a header 6'. The header 6' has a top surface having a width somewhat larger than the width of the gap between the slabs 2 and 3. Thus, a casing or form is provided which is closed along its longitudinal sides by the side walls of the slabs and at its bottom by the top surface of the header 6' when the prefabricated element is placed on top of the header 6', as shown in FIG. 4.

Connecting bails 7 are rigidly secured to or embedded in the header 6'. Preferably the bails 7 form closed loops which extend out of the top surface of the header to such an extent that they reach slightly above the top edges of the ribs 4. Further, the bails 7 are so oriented and spaced from each other that they fit through the gaps between the ribs 4. After placing the prefabricated element, as shown in FIG. 4, reinforcing rods 8 are inserted into the bails 7 so as to rigidly interconnect these bails with the ribs 4, somewhat in a wedging manner. In this manner a simple, but nevertheless very rigid interconnection is instantaneously accomplished between the header and the prefabricated elements 1, whereby a displacement of the element 1 relative to the header 6' is prevented. Thereafter, the gap is filled with poured-in-place concrete, however, it is not necessary to wait for the hardening of the concrete because the rigidity of the interconnection is assured by the bails 7 and the rods 8 extending across the ribs 4. However, the concrete in the gap which may be screeded off along the ridge 5 and the top surface of the flap 3 will reinforce the entire interconnection.

From FIG. 4 it will be noted that the width of the header 6' is such that the inner end of the slab 2 as well as the outer end of the slab 3 both rest completely on the header 6'. This feature not only contributes to the strength of the interconnection, but also has the advantage that the casing is closed at its bottom for the poured-in-place concrete as described above. In this connection, it should be mentioned that the raised ridge 5 obviates the need for a lateral casing member which would be otherwise required, since the thickness of the slab section 2 is smaller than the thickness of the slab section 3. Further, since the ribs 4 also have a height smaller than the thickness of the slab 3, it is possible to completely fill the gap or joint between the slab sections 2 and 3 so that the header in fact extends all the way to the top surface of the slab section 3. As a result, for the calculation of structural strength purposes it is possible to assume that the header reaches all the way to the dashed line interconnecting the top surface of the slab section 3 with the ridge 5. This feature results in a substantial saving of materials, because the double T-girder heretofore required is not necessary where the teachings according to the invention are employed.

The grooves 11 in the side walls of the ribs 4 may extend all around these ribs so that an intermeshing bond is accomplished between the ribs 4 and the concrete poured-in-place. In this manner the ribs 4 are enabled to take up tensile forces or loads in an especially efficient manner.

Incidentally, adjacent floor slabs 3 may be interconnected with each other by means of the protruding connecting bails 10, whereby two such slabs are brought into alignment with each other, whereupon reinforcing rods are inserted into the over-lapping bails of two adjacent slabs. After insertion of the rods which extend across the width of the slabs 3 and thus across the bails 10, poured-in-place concrete is filled into the gaps between adjacent slabs.

Although the invention has been described with reference to specific example embodiments, it is to be understood, that it is intended to cover all modifications and equivalents within the scope of the appended claims.

What is claimed is:

1. A building structure comprising a prefabricated integral structural element and a supporting member having a predetermined width at its supporting surface, said prefabricated strucural element comprising a main floor section of a given thickness, a cantilevered floor section, rib means comprising reinforcing rod means rigidly interconnecting said main floor section and said cantilevered section in spaced relation so as to form a gap between the sections, said rod means extending uninterrupted across the gap, said rib means being spaced from each other to define passages therebetween said rib means being of smaller height than said given thickness, said element being supported on said supporting surface, said rib means having a length between said main floor section and said cantilevered section that is less than said width of said supporting surface so that the bottom of said gap is closed by said supporting surface, means rigidly secured to said supporting member to extend out of the supporting surface and into said gap for cooperation with said rib means for interconnecting said supporting member with said structural element, concrete filling said gap thereby embedding said rib means and said interconnecting means to form an integral structural combination, and further reinforcing rod means running substantially the entire length of the gap.

2. The building structure according to claim 1, wherein said supporting member is a header having a top surface wider than said gap whereby the top surface of the header forms a bottom of the gap, and the rods of the rib means extend across the top surface of the header.

3. The building structure according to claim 2, wherein said means rigidly secured to said header comprise bail means extending upwardly through said passages between said ribs, said further reinforcing rod means connecting said bail means and said rib means, said further rod means extending across said rib means and through said bail means, said concrete embedding said rod means forming the rib means, said further rod means and said bail means thereby forming said integral structural combination.

4. The building structure according to claim 1, wherein said reinforcing rod means of the rib means are embedded in concrete to form rigid rib bodies having grooves on the outside thereof, said rib bodies being embedded in said first mentioned concrete.

5. The building structure according to claim 1, wherein said cantilevered section has a smaller thickness than said given uniform thickness of said main floor section.

6. The building structure according to claim 1, wherein said cantilevered section comprises a ridge extending along one side of said cantilevered section adjacent to and in parallel to said gap, said ridge extending upwardly and having a thickness such that the top of the ridge is substantially level with said main floor section above said supporting member.

7. A prefabricated integral structural element comprising a main floor section of given thickness, a cantilevered floor section thinner than said given thickness, and rib means rigidly interconnecting said main floor section and said cantilevered floor section, said rib means being spaced from each other and defining passages therebetween, said rib means being of smaller height than said given thickness wherein said cantilevered section comprises a ridge extending along one side of said cantilevered section adjacent said rib means, said ridge being directed upwardly and having a thickness greater than said height of said rib means to form a gap between the sections, said rib means bridging said gap.

* * * * *